US009259372B2

(12) United States Patent
Steinman et al.

(10) Patent No.: US 9,259,372 B2
(45) Date of Patent: Feb. 16, 2016

(54) POOL ACCESS APPARATUS

(75) Inventors: Lee Steinman, Pigeon, MI (US); Gary Steinman, Elkton, MI (US); Dale Steinman, Pigeon, MI (US); Jeremy Steinman, Pigeon, MI (US); Joshua Steinman, Pigeon, MI (US)

(73) Assignee: Global Lift Corporation, Bad Axe, MI (US)

( * ) Notice: Subject to any disclaimer, the term of this patent is extended or adjusted under 35 U.S.C. 154(b) by 310 days.

(21) Appl. No.: 14/008,273

(22) PCT Filed: Mar. 29, 2012

(86) PCT No.: PCT/US2012/031287

§ 371 (c)(1),
(2), (4) Date: Sep. 27, 2013

(87) PCT Pub. No.: WO2012/135538

PCT Pub. Date: Oct. 4, 2012

(65) Prior Publication Data

US 2014/0013499 A1 Jan. 16, 2014

Related U.S. Application Data

(60) Provisional application No. 61/468,960, filed on Mar. 29, 2011.

(51) Int. Cl.
*E04H 4/14* (2006.01)
*A61G 7/10* (2006.01)

(52) U.S. Cl.
CPC ..... *A61G 7/1005* (2013.01); *A61G 7/1017* (2013.01); *A61G 7/1044* (2013.01); *A61G 7/1059* (2013.01); *E04H 4/144* (2013.01)

(58) Field of Classification Search
CPC ..... A61G 7/1005; A61G 7/1017
USPC ..... 4/496
See application file for complete search history.

(56) References Cited

U.S. PATENT DOCUMENTS

| | | | | |
|---|---|---|---|---|
| 4,554,691 | A * | 11/1985 | Daugherty | A61G 7/1017 318/16 |
| 4,996,728 | A * | 3/1991 | Nolan | A61G 7/1005 4/496 |
| 6,009,572 | A | 1/2000 | Morris | |
| 2005/0086730 | A1 | 4/2005 | Terzo | |
| 2006/0048294 | A1 | 3/2006 | Maguire et al. | |
| 2006/0252606 | A1 | 11/2006 | Korb et al. | |
| 2014/0331399 | A1* | 11/2014 | Steinman | A61G 7/1005 4/496 |

* cited by examiner

*Primary Examiner* — Huyen Le
(74) *Attorney, Agent, or Firm* — Reising Ethington P.C.

(57) ABSTRACT

A pool access apparatus for moving a disabled person between a pool deck and a pool includes an arm supported for pivotal motion about a base axle and a seat supported for pivotal motion about a seat axle carried by the arm. A driver pivots the arm between a deployed position suspending the seat at least partially within the pool, and a stowed position suspending the seat in a position displaced laterally from the pool. The apparatus may include a chain-driven seat attitude maintenance linkage, an anchoring system comprising a sub-plate embedded in or disposed below the deck to which a base plate of the apparatus is removably connectable, and/or a wheeled portability kit that is removably connectable to the base plate.

21 Claims, 7 Drawing Sheets

POOL ACCESS APPARATUS

TECHNICAL FIELD

This invention relates generally to an apparatus for moving a disabled person between a pool deck and a pool.

BACKGROUND

The Americans with Disabilities Act (ADA) sets forth standards and requirements regarding the accessibility of swimming pools to handicapped or disabled persons. Public pools are required to have at least one method of disabled access, commonly manifested in the form of a ramp or lift, and the act describes extensive systems, design, and operation specifications required for a device to be considered ADA compliant. Common lift engineering challenges include securing the lift to the ground, providing a strong and steady drive system to move the lift, stabilizing the lift's chair to remain upright during deployment, and designing safety systems.

SUMMARY

A pool access apparatus for moving a disabled person between a pool deck and a pool comprises a base axle supportable adjacent an edge of a basin and generally above a surface level of fluid retained in the basin, and an arm having an arm inner end supported on the base axle for pivotal motion about a base axis disposed coaxially with the base axle. A seat axle is carried by the arm adjacent an outer end of the arm and is oriented generally parallel to the base axis. A seat configured to carry a passenger is supported on the seat axle for pivotal motion about a seat axis disposed coaxially with the seat axle. A driver is connected between the arm and a fixed structure adjacent the basin and is actuable to pivot the arm between a deployed position suspending the seat at least partially within the basin, and a stowed position suspending the seat in a position displaced laterally from the basin. The apparatus may also include a seat attitude maintenance linkage. The linkage may comprise a fixed chain sprocket supported coaxially on the base axle and fixed against rotational motion about the base axis. The linkage may also include a rotary chain sprocket supported coaxially on the seat axle for rotational motion about the seat axis, and a roller chain engaged on and extending between the fixed and rotary chain sprockets.

The apparatus may include a base supportable on a fixed structure adjacent an edge of a basin and generally above a surface level of fluid retained in such a basin. The base axle may be fixed to the base, and the driver may be connected between the arm and the base. The base may include a generally flat plate configured to lie flat on a level top surface of a deck and that may be configured to removably connect to a wheeled portability kit.

The apparatus may include an anchoring system comprising a sub-plate configured to be embedded in or disposed below the deck, as well as one or more lengths of internally-threaded pipe configured to be disposed in respective holes formed in the deck between the base plate and the sub plate. The anchoring system may also comprise one or more upper bolts configured to be passed through holes formed through the base plate in alignment with the holes formed in the deck and threadedly engaged in respective upper ends of the pipe lengths disposed in the holes formed in the deck. The anchoring system may also comprise one or more lower bolts configured to be passed through holes formed through the sub plate in alignment with the holes formed in the deck and threadedly engaged in respective lower ends of the pipe lengths disposed in the holes formed in the deck.

BRIEF DESCRIPTION OF THE DRAWINGS

These and other features and advantages of the invention will become apparent to those skilled in the art in connection with the following drawings.

DETAILED DESCRIPTION

Figure 1:
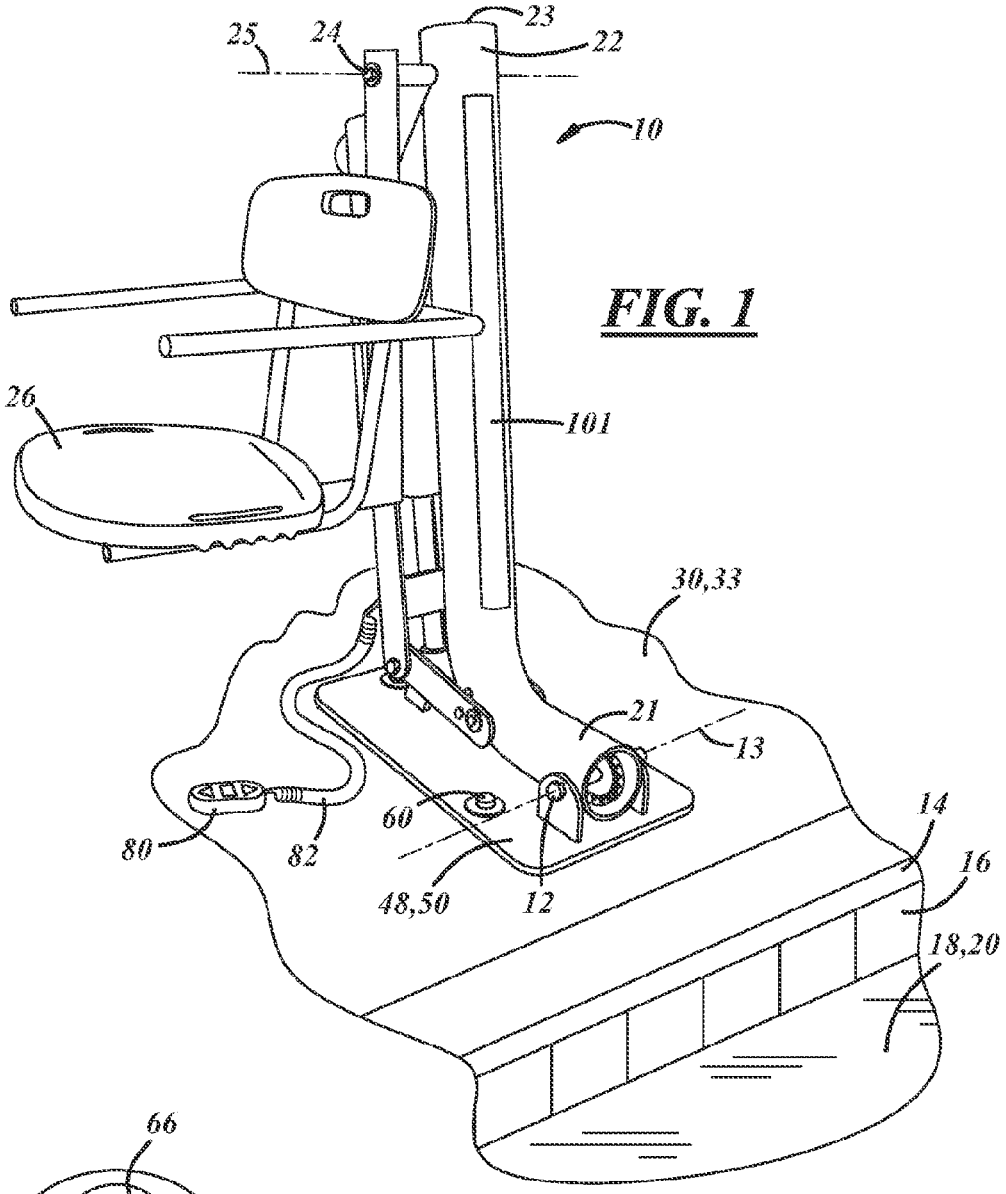
FIG. 1 is a perspective view of a pool access apparatus installed on a pool deck adjacent a pool.
Figure 13:
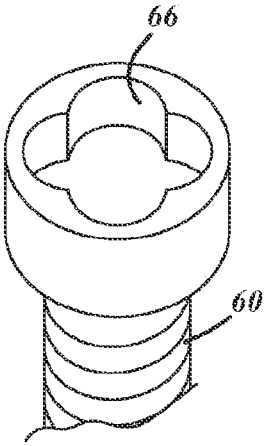
FIG. 13 is a fragmentary perspective view of one of the upper bolts of the anchoring system.

A pool access apparatus for moving a disabled person between a pool deck and a pool is generally shown at 10 in FIGS. 1-5 and 14. The apparatus 10 may include a base axle 12 that may be configured to be removably supported adjacent an edge 14 of a basin 16 such as a swimming pool or spa, and generally above a surface level 18 of fluid 20, such as water, retained in such a basin 16. The apparatus 10 may also include a support beam or arm 22 supported at an arm inner end 21 on the base axle 12 for pivotal motion about a base axis 13, the base axis 13 being coaxially disposed with the base axle 12.

The apparatus 10 may also include a seat axle 24 that is carried by the arm 22 adjacent an outer end 23 of the arm 22 and that is oriented generally parallel to the base axis 13 and base axle 12. The apparatus 10 may further include a seat 26 that may be carried by and fixed to the seat axle 24 for pivotal motion about a seat axis 25 that is coaxially disposed with the seat axle 24. The seat 26 may be shaped and otherwise configured to carry a passenger in a seated position.

A driver 28 may be connected between the arm 22 and a fixed structure or surface 30 adjacent the basin 16. The driver 28 may be actuable to pivot the arm 22 between a deployed position and a stowed position. In the deployed position the seat 26 may be suspended in or over the basin 16 in a location where a passenger can move easily between the seat 26 and the water 20. In the stowed position the seat 26 may be suspended in a position over a surface 30, such as a pool deck, that is displaced from the basin 16. In the stowed position the seat 26 may be suspended in a position over the surface 30 where a passenger can move easily between the seat 26 and the surface 30. The driver 28 may be of any suitable type and may, for example, be an electric motor-driven linear actuator of a type available from LINAK Group. The apparatus 10 may be configured to be upgradable to greater weight-carrying capability by selection and installation of a more powerful driver 28, e.g., a linear actuator capable of applying greater push-pull forces.

Figure 5:
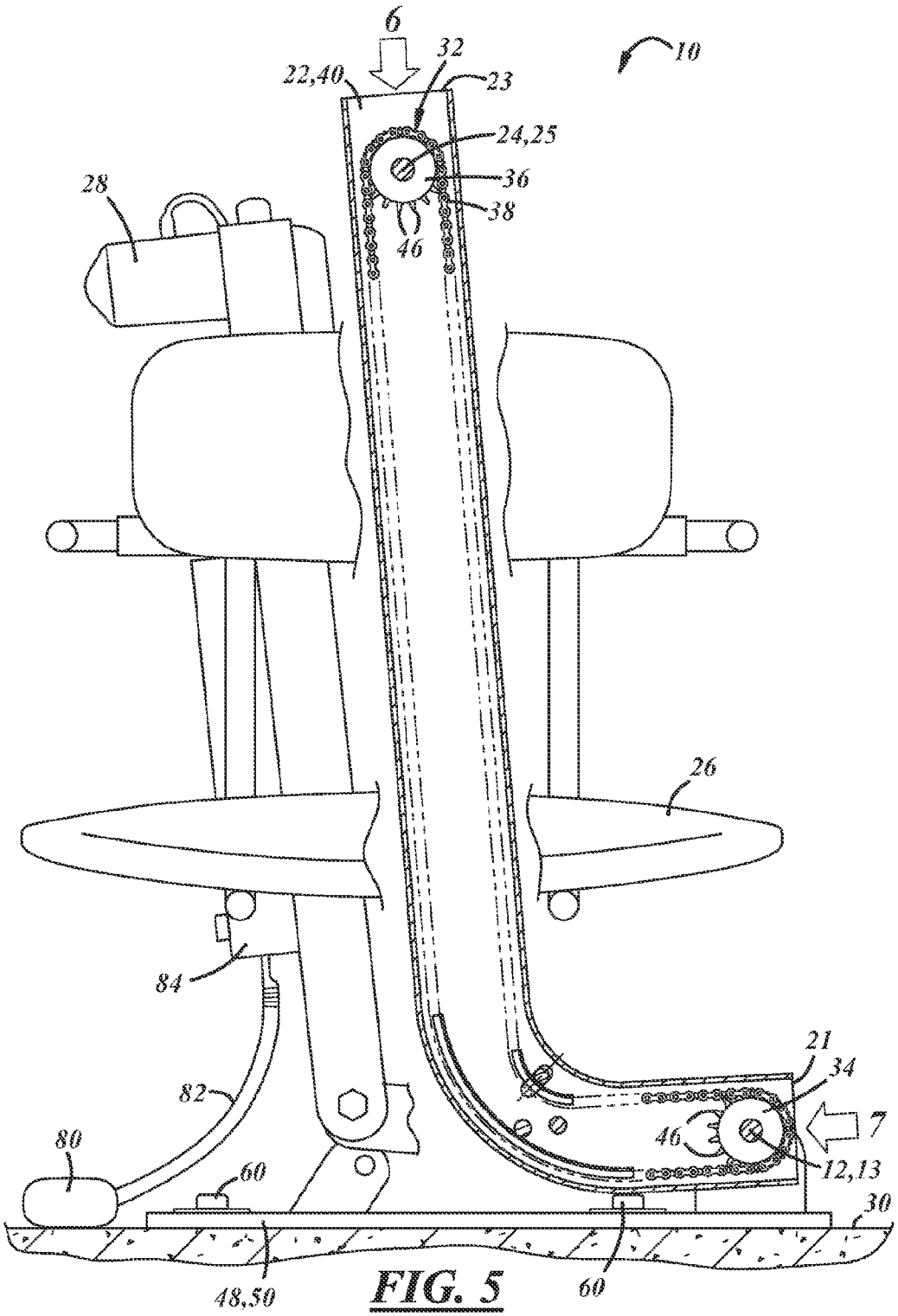
FIG. 5 is a partially cutaway partial cross-sectional front view of the apparatus of FIG. 1 revealing a seat attitude maintenance linkage of the apparatus within a tubular support arm of the apparatus of FIG. 1.
Figure 6:
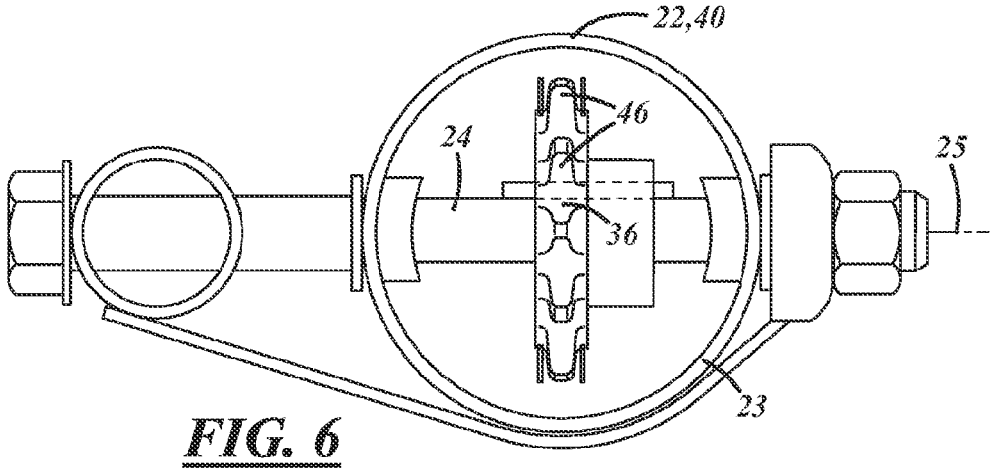
FIG. 6 is a top end view of the support arm, a seat axle of the apparatus, and a portion of the seat attitude maintenance linkage visible at an outer end of the support arm.
Figure 7:
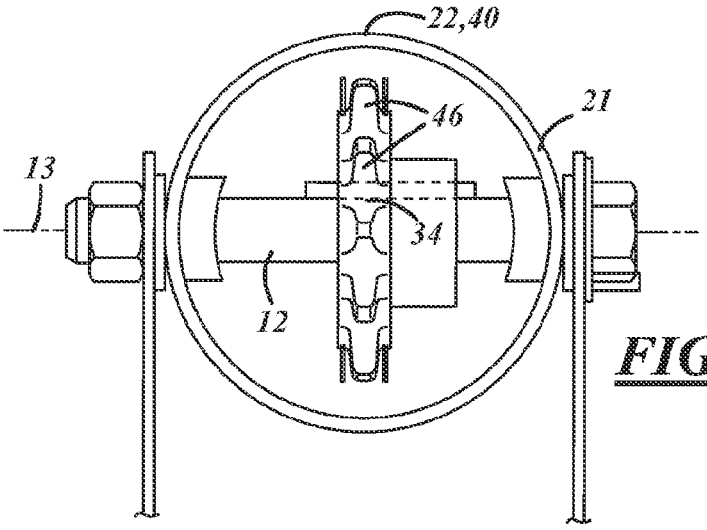
FIG. 7 is a front end view of the support arm, a base axle of the apparatus, and a portion of the seat attitude maintenance linkage visible at an inner end of the support arm.

As best shown in FIGS. 5-7, the apparatus 10 may also include a seat attitude maintenance linkage 32 that may comprise a fixed chain sprocket 34 supported coaxially on the base axle 12 and fixed against rotational motion about the base axis 13. The seat maintenance linkage 32 may also include a rotary chain sprocket 36 supported coaxially on the seat axle 24 for rotational motion about the seat axis 25. A roller chain 38 may be engaged on and extend between the fixed 34 and rotary 36 chain sprockets in such a way as to maintain a generally constant upright seat attitude throughout the arm's travel between the deployed and stowed positions.

The arm 22 may include an approximate 90 degree bend configured and positioned to increase the circumferential distance that the end of the arm 22 can be rotated around the base axis 13 without the arm's travel being arrested prematurely by the edge 14 of a basin 16 into which the seat 26 is being lowered. This allows the seat 26 to be submerged far enough into the water 20 to lower a passenger to a depth from which the passenger can easily disembark and embark. The driver 28 may be connected to the arm 22 at a point along the arm 22 adjacent the bend in the arm 22.

As best shown in FIG. 5-7, the arm 22 may comprise a hollow tube 40. The fixed 34 and rotary 36 chain sprockets and the roller chain 38 may be disposed within the hollow tube 40. In the present embodiment the tube 40 is a four inch diameter tube but, in other embodiments, the tube 40 may be of any suitable diameter. The apparatus 10 may include at least one chain guide 42 positioned to guide the roller chain 38 around the bend in the arm 22 to reduce friction and wear between the chain 38 and an inner wall 41 of the tube 40. The chain guide 42 may include or may be movably supported by a chain tensioner 44 configured to maintain a desired amount of chain tension, the desired amount generally being a sufficient amount of chain tension to prevent the roller chain 38 from slipping over teeth 46 of the chain sprockets 34, 36.

The apparatus 10 may include a base 48 that may be removably supportable on a fixed support structure or support surface 30 such as a pool deck and adjacent an edge 14 of a basin 16 such as a swimming pool or spa and generally above a surface level 18 of a fluid 20, such as water, retained in such a basin 16. The base axle 12 may be fixed to the base 48, and the driver 28 may be connected between the arm 22 and the base 48 in such a way that the apparatus 10 may be secured to a support surface 30 by securing only the base 48 to the support surface 30, and without having to separately attach a free end of the driver 28 to a support structure or support surface 30 during installation of the pool access apparatus 10.

Figure 10:
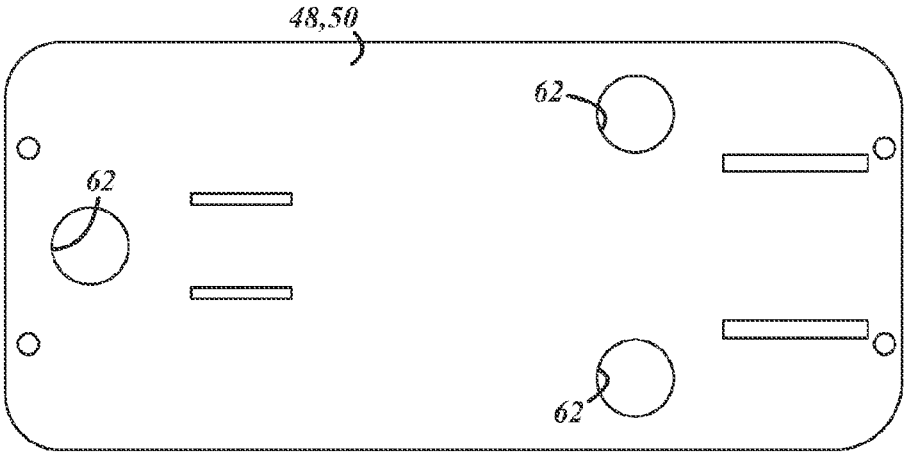
FIG. 10 is a top view of a base plate of the apparatus of FIG. 1.
Figure 11:
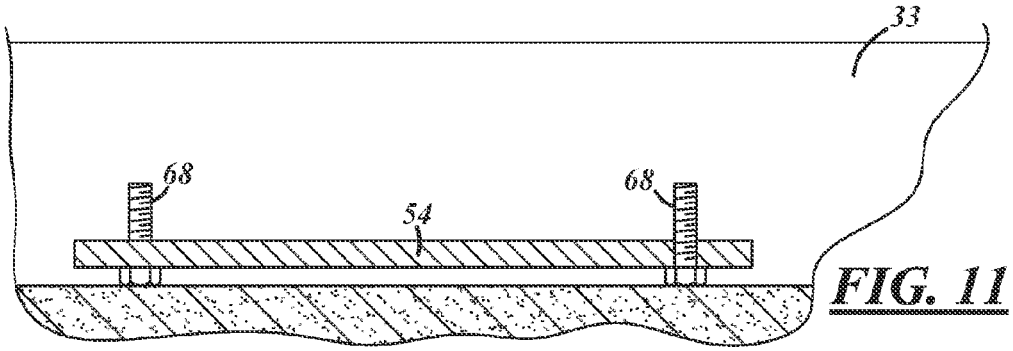
FIG. 11 is a cutaway view of a sub plate and lower bolts of an anchoring system of the apparatus of FIG. 1 positioned to be embedded in a concrete slab in a pool deck.
Figure 12:
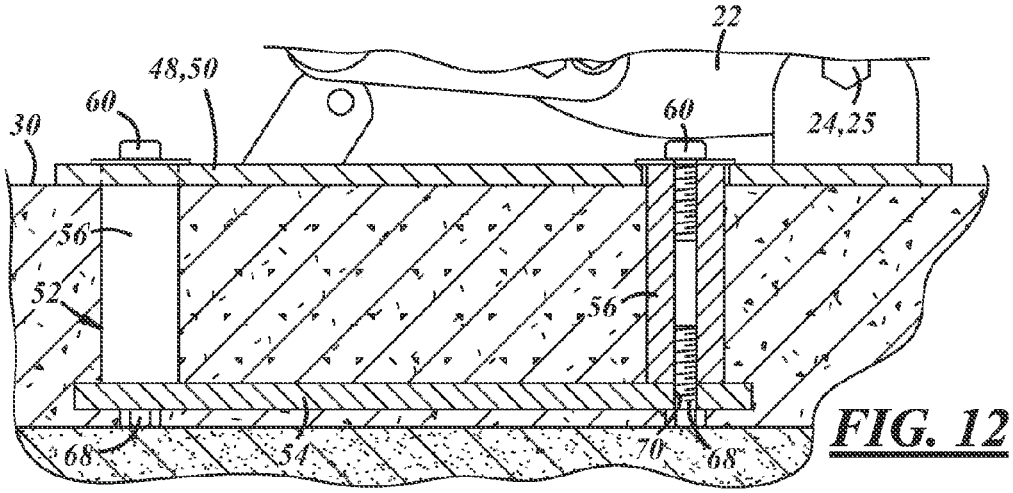
FIG. 12 is a cutaway view of the sub plate, lower bolts, and pipes of the anchoring system shown embedded in a concrete slab, and with the base plate of the apparatus of FIG. 1 fastened to the pipes by upper bolts of the anchoring system.

As best shown in FIGS. 10-12, the base 48 may include a generally flat rectangular plate 50 that is shaped to lay flat on a level top surface 30 of a pool or spa deck that comprises, for example, a concrete slab 33. The apparatus 10 may further include an anchoring system 52 comprising a rectangular sub-plate 54 that may be of the approximate same size, shape, and gauge as the base plate 50. The sub-plate 54 may be embedded in the pool or spa deck slab 33 in a generally parallel orientation relative to and spaced below the base plate 50, or may be disposed below such a slab 33 in a generally parallel orientation relative to and spaced below the base plate 50. The anchoring system 52 may also include three approximately 6 inch lengths of internally-threaded steel pipe 56 that may be embedded in the concrete spa or pool deck slab 33 between the base plate 50 and the sub plate 54, or may be inserted into respective generally vertical holes formed in the concrete spa or pool deck slab 33 between the base plate 50 and the sub plate 54. Three upper bolts 60 may be passed through three holes 62 formed in the base plate 50 and may be threadedly engaged in respective upper ends of the three pipe lengths 56. The upper bolts 60 may further be configured to include locking devices or non-standard wrench engagement interface configurations 66 to prevent or at least discourage removal by unauthorized individuals. Three lower bolts 68 may be passed through three holes 70 formed through the sub plate 54 in alignment with the three holes 58 formed in the slab 33. The three lower bolts 68 may be threadedly engaged in respective lower ends of the three pipe lengths 56. In the present embodiment the base and sub plates 50, 54 comprise 12 gauge steel but could comprise any suitable thickness and composition in other embodiments.

Figure 14:
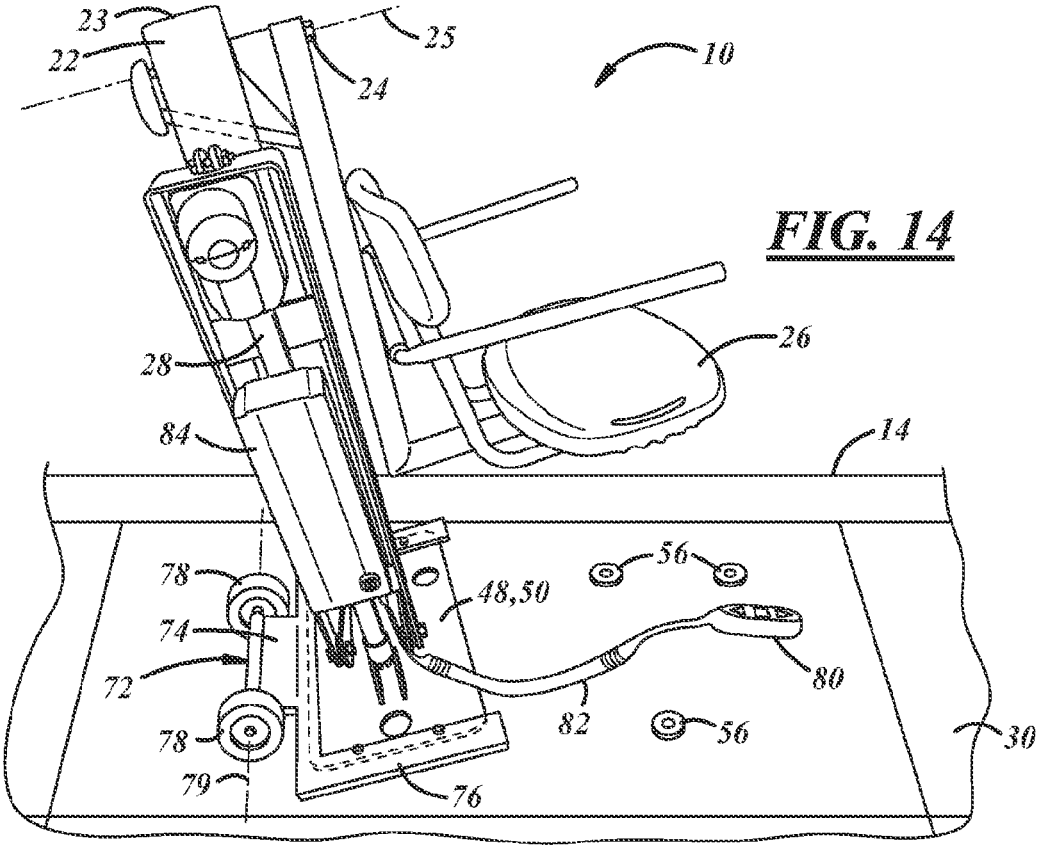
FIG. 14 is a perspective view of a portability system connected to the base plate of the apparatus of FIG. 1 and showing the apparatus tilted back onto wheels of the portability system for transport.

As shown in FIG. 14 the apparatus 10 may include a portable capability system generally 72 in which the base 48 may be configured to removably connect to a wheeled portability kit 74 such that a non-mobile version of the apparatus 10 is convertible to a mobile version of the apparatus 10 by installation of the wheel kit 74. The wheeled portability kit 74 may, for example, comprise a wheeled plate 76 configured to be connected to the apparatus base plate 50. Two wheels 78 may be coaxially supported for rotation about a common transport wheel axis 79 at respective opposite ends of the wheeled plate 76 in respective positions allowing the base plate 50 to lie flat on an underlying support surface 30 when the apparatus 10 is not tilted around the wheel axis 79, and allowing the wheels 78 to carry the weight of the apparatus 10 on the underlying support surface 30 when the apparatus 10 is tilted back around the transport wheel axis 79 for transport across the support surface 30.

The apparatus 10 may include a handheld lift control panel 80 that may be connected by a cord 82 to a control box 84 that is, in turn, connected to the driver 28. The control panel 80 is configured to allow a passenger or other operator to remotely actuate the driver 28 to move the arm 22 and suspended seat 26 between the deployed and stowed positions.

Figure 9:
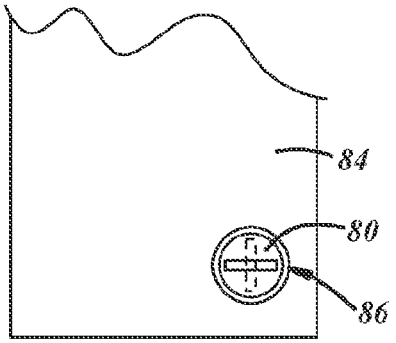
FIG. 9 is a fragmentary view of a control box of the apparatus and showing a key engaged in a key lock cylinder of a safety lockout system of the apparatus of FIG. 1.
Figure 3:
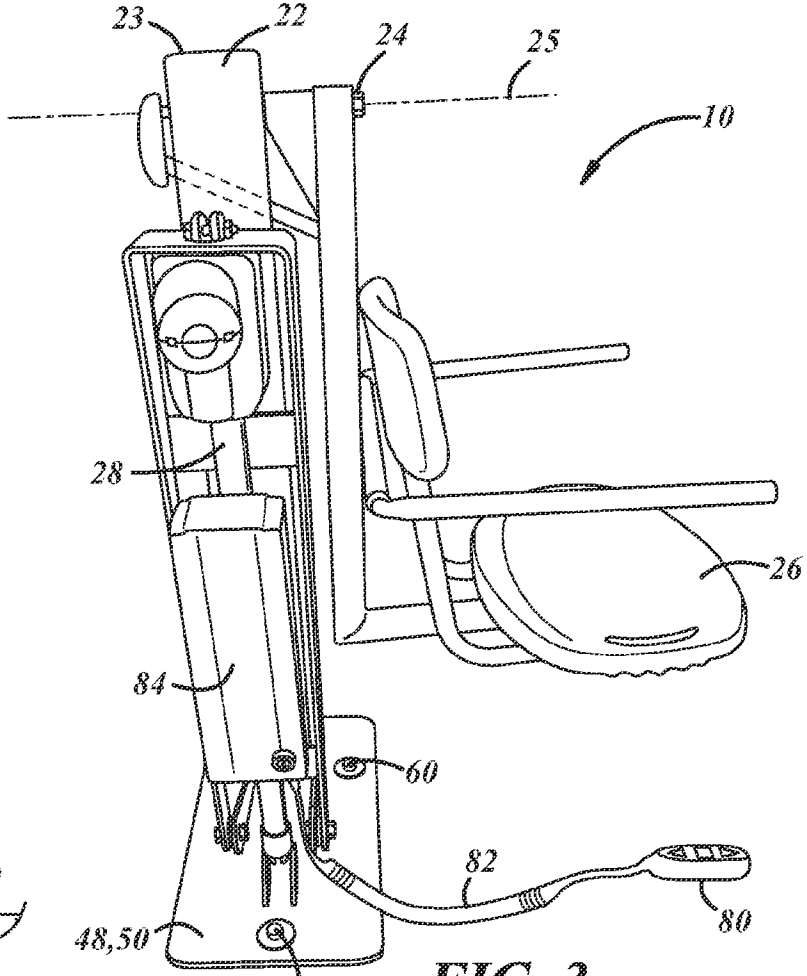
FIG. 3 is a left side perspective view of the apparatus of FIG. 1.
Figure 2:
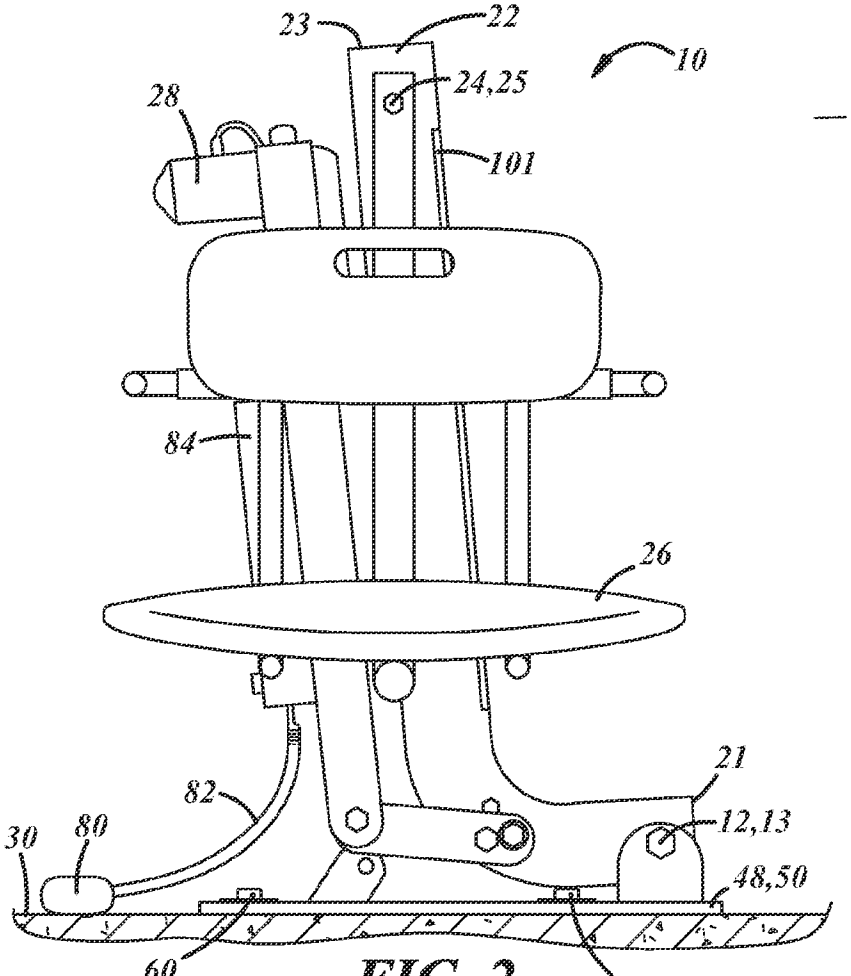
FIG. 2 is a front view of the apparatus of FIG. 1.
Figure 4:
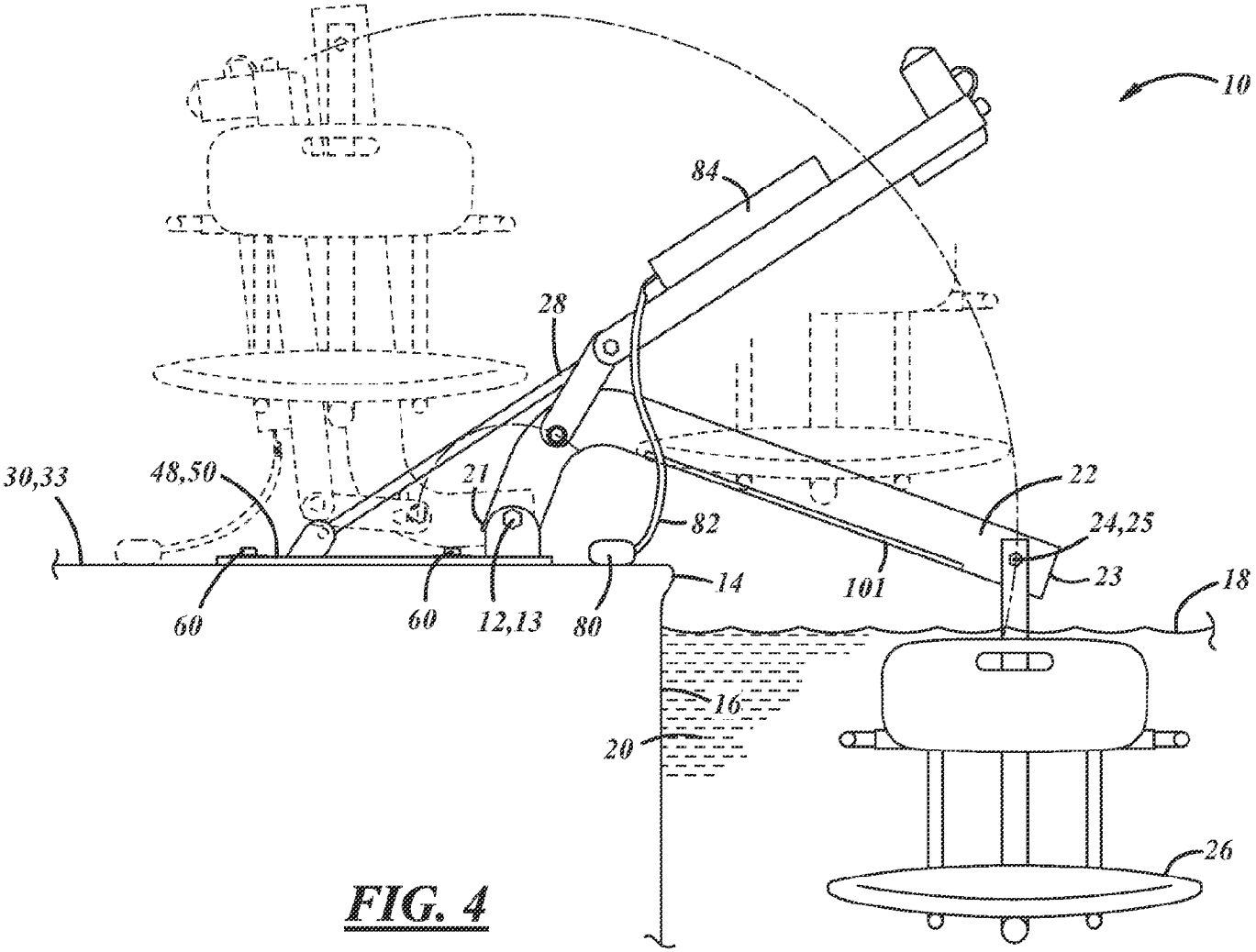
FIG. 4 is a front view of the apparatus of FIG. 1 showing a deployed position of the apparatus and, in phantom, showing a stowed position of the apparatus.
Figure 15:
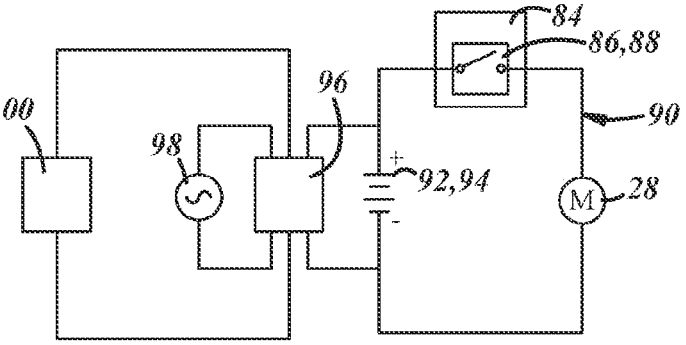
FIG. 15 is a schematic circuit diagram of a driver power supply circuit of the apparatus of FIG. 1.

As shown in FIGS. 9 and 15, the apparatus 10 may also include a safety lock-out system 86 including a key switch 88 carried by the control box 84 and connected in a driver power supply circuit 90 between the driver 28 and a power supply 92 such as a battery 94. The lock-out system 86 may be configured to prevent the apparatus 10 from operating when the key switch 88 is in an off position, opening the driver power supply circuit 90. This prevents the apparatus 10 from being operated without a key.

The apparatus 10 may include an on-board power supply 92, such as a battery 94, which is connected into the driver power supply circuit 90 as shown in FIG. 15. The apparatus 10 may also include a battery charger 96 that may be connected between the battery 94 and an external electrical power supply 98. The battery charger 96 may be configured to charge and maintain the battery 94 at a predetermined desired charge state when the battery charger 96 is connected to an external electric power supply 98.

The on-board power supply 92 may also include a solar device 100 that may be connected to the battery charger 96 to provide an alternative source of electric power for charging the battery 94. The solar device 100 may be of any suitable type known in the art to include a solar panel comprising photovoltaic cells or solar photovoltaic tape 101. Where solar photovoltaic tape is used, and as shown in Figure I, it may be adhered to a surface of the apparatus 10 in a position where it will have adequate exposure to solar rays.

Figure 8:
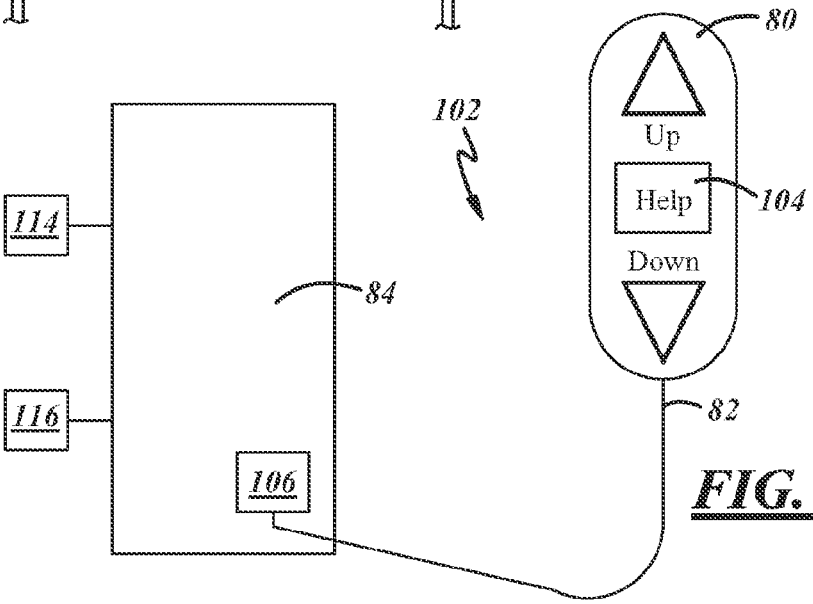
FIG. 8 is a schematic representation of an alert system of the apparatus of FIG. 1.
Figure 16:
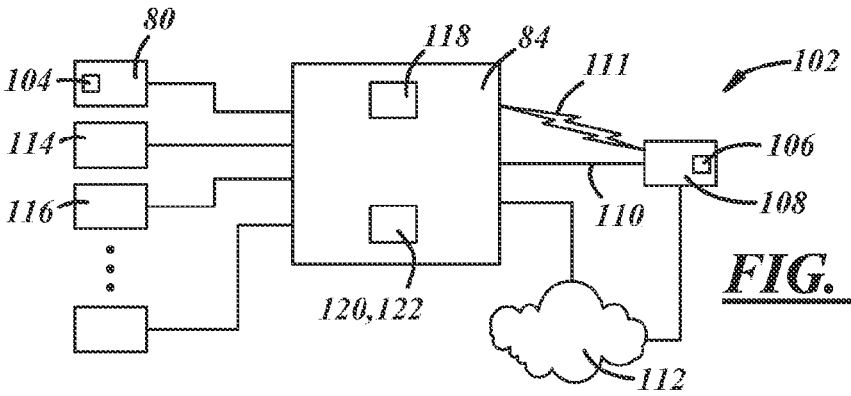
FIG. 16 is a schematic block diagram of a safety alert system of the apparatus of FIG. 1.

The apparatus 10 may include a safety alert system 102 in FIGS. 8 and 16 including an alarm button 104 carried on the handheld lift control panel 80 and an audible and/or visual alarm 106 carried by the control box 84 as shown in FIG. 8. A passenger may alert a facility attendant to the passenger's need for assistance, by pressing the alarm button 104 to activate the alarm 106. The audible and/or visual alarm 106 may also, or alternatively, be disposed at a remote monitoring station 108 such as the main desk of a hotel and/or a local emergency dispatch service as shown in FIG. 16. Such a remotely located alarm 106 may be connected to and configured to receive alarm signals from the alarm button 104 via a hard-wired electrical circuit 110, electromagnetic radiation transmission 111, and or an existing communications network 112 such as a cell phone network, a land line telephone network, and/or a computer communications network such as the interne. The alarm signal may include information indicating that someone needs assistance at a pool lift. The alarm signal may also include information indicating the location of the pool lift at which the alarm 106 was or is being actuated.

The safety alert system 102 may include a camera 114 that may be carried by the apparatus 10 and that may be configured to capture images of an area that includes the apparatus seat 26 and to transmit corresponding video signals to the remote monitoring station 108. The transmitted video signals may be processed for viewing and/or recorded at the remote monitoring station 108. The camera 114 may be turned on and/or commanded to capture images and transmit video signals upon actuation of the alarm button 104.

The safety alert system 102 may also include a microphone 116 that may be carried by the apparatus 10 and that may be configured to capture sounds audible in the vicinity of the apparatus 10 and to transmit corresponding audio signals to the remote monitoring station 108. The transmitted audio signals may be processed for listening and/or recorded at the remote monitoring station 108. The microphone 116 may be turned on and/or commanded to capture sounds and transmit audio signals upon actuation of the alarm button 104.

The safety alert system 102 may also include a microprocessor 118 that may be programmed to delay transmission of alarm signals and any related data such as audio and/or video signals to the remote monitoring system 108 or a predetermined time period. This time delay allows false activations to be cancelled before alerting personnel monitoring the remote monitoring system 108.

The apparatus 10 may include a status monitoring and reporting system 120 that may include a microprocessor 122 carried by the control box 84. The microprocessor 122 may be programmed to record data such as battery charge level as well as scheduled and accomplished maintenance events such as lubrication. The microprocessor 122 may be programmed to transmit such data - either continuously or at predetermined intervals—to a remote monitoring station 108 at a location such as the main desk of a hotel. The remote monitoring station 108 may be connected to and configured to receive data from the microprocessor via a hard-wired electrical circuit 110, electromagnetic radiation transmission 111, and or an existing communications network 112 such as a cell phone network, a land line telephone network, and/or a computer communications network such as the internet.

This description, rather than describing limitations of an invention, only illustrates an embodiment of the invention recited in the claims. The language of this description is therefore exclusively descriptive and is non-limiting. Obviously, it's possible to modify this invention from what the description teaches. Within the scope of the claims, one may practice the invention other than as described above.

What is claimed is:

1. A pool access apparatus for moving a disabled person between a pool deck and a pool, the apparatus comprising:

a base axle supportable adjacent an edge of a basin and generally above a surface level of fluid retained in the basin;

an arm having an arm inner end supported on the base axle for pivotal motion about a base axis disposed coaxially with the base axle;

a seat axle carried by the arm adjacent an outer end of the arm and oriented generally parallel to the base axis;

a seat supported on the seat axle for pivotal motion about a seat axis disposed coaxially with the seat axle, the seat being configured to carry a passenger;

a driver connected between the arm and a fixed structure adjacent the basin and actuable to pivot the arm between a deployed position suspending the seat at least partially within the basin, and a stowed position suspending the seat in a position displaced laterally from the basin; and the arm includes a bend configured and positioned to increase the circumferential distance that the arm can be rotated around the base axis without its travel being arrested by the edge of a basin into which the seat is being lowered.

2. A pool access apparatus as defined in claim 1 in which:

the apparatus includes a seat attitude maintenance linkage comprising:

a fixed chain sprocket supported coaxially on the base axle and fixed against rotational motion about the base axis, a rotary chain sprocket supported coaxially on the seat axle for rotational motion about the seat axis, and a roller chain engaged on and extending between the fixed and rotary chain sprockets; and the arm comprises a hollow tube; and the fixed and rotary chain sprockets and the roller chain are disposed within the hollow tube.

3. A pool access apparatus as defined in claim 2 in which the apparatus includes at least one chain guide positioned to guide the roller chain through the bend in the arm.

4. A pool access apparatus as defined in claim 3 in which the at least one chain guide is a chain tensioner configured to maintain a desired amount of tension in the chain.

5. A pool access apparatus as defined in claim 1 in which:

the apparatus includes a base supportable on a fixed structure adjacent an edge of a basin and generally above a surface level of fluid retained in the basin;

the base axle is fixed to the base; and the driver is connected between the arm and the base.

6. A pool access apparatus as defined in claim 1 in which the driver is connected to the arm adjacent the bend in the arm.

7. A pool access apparatus as defined in claim 1 in which the apparatus includes a lift control panel connected to the driver and configured to allow a passenger or other operator to remotely actuate the driver to move the arm and suspended seat between the deployed and stowed positions.

8. A pool access apparatus as defined in claim 1 in which the apparatus includes a safety alert system including an alarm button carried on the lift control panel and an alarm activatable by actuation of the alarm button.

9. A pool access apparatus as defined in claim 8 in which the alarm is disposed at a remote monitoring station connected to and configured to receive an alarm signal from the alarm button via a hard-wired electrical circuit, electromagnetic radiation transmission, and/or a communications network.

10. A pool access apparatus as defined in claim 9 in which the alarm signal includes information indicating that assistance is desired.

11. A pool access apparatus as defined in claim 9 in which the safety alert system includes a camera carried by the apparatus and configured to capture images and transmit corresponding image signals to the remote monitoring station upon actuation of the alarm button.

12. A pool access apparatus as defined in claim 9 in which the safety alert system includes a microphone carried by the apparatus and configured to capture sound and transmit corresponding audio signals to the remote monitoring station upon actuation of the alarm button.

13. A pool access apparatus as defined in claim 9 in which the safety alert system includes a microprocessor programmed to delay transmission of alarm signals to the remote monitoring station for a predetermined time period to allow false activations to be cancelled.

14. A pool access apparatus as defined in claim 1 in which the apparatus includes a safety lock-out system that includes a switch connected in a driver power supply circuit between the driver and a power supply and configured to alternately open and close the drive power supply circuit.

15. A pool access apparatus as defined in claim 1 in which the apparatus includes a status monitoring and reporting system comprising a microprocessor programmed to record apparatus status data and to transmit such data to the remote monitoring station via a hard-wired electrical circuit, electromagnetic radiation transmission, and/or a communications network.

16. A pool access apparatus as defined in claim 1 in which:

the apparatus includes a driver power supply circuit connected between the driver and an electrical power supply;

the electrical power supply includes an on-board power supply comprising a solar device.

17. A pool access apparatus as defined in claim 16 in which the solar device includes photovoltaic tape.

18. A pool access apparatus for moving a disabled person between a pool deck and a pool, the apparatus comprising:

a base axle supportable adjacent an edge of a basin and generally above a surface level of fluid retained in the basin;

an arm having an arm inner end supported on the base axle for pivotal motion about a base axis disposed coaxially with the base axle;

a seat axle carried by the arm adjacent an outer end of the arm and oriented generally parallel to the base axis;

a seat supported on the seat axle for pivotal motion about a seat axis disposed coaxially with the seat axle, the seat being configured to carry a passenger;

a driver connected between the arm and a fixed structure adjacent the basin and actuable to pivot the arm between a deployed position suspending the seat in or over the basin, and a stowed position suspending the seat in a position displaced from the basin;

a base supportable on a fixed structure adjacent an edge of a basin and generally above a surface level of fluid retained in such a basin, the base axle being fixed to the base, and the driver being connected between the arm and the base, the base including a generally flat plate configured to lie flat on a level top surface of a deck; and an anchoring system comprising:

a sub-plate configured to be embedded in or disposed below the deck, one or more lengths of internally-threaded pipe configured to be disposed in respective holes formed in the deck between the base plate and the sub plate, one or more upper bolts configured to be passed through holes formed through the base plate in alignment with the holes formed in the deck and threadedly engaged in respective upper ends of the pipe lengths disposed in the holes formed in the deck, and one or more lower bolts configured to be passed through holes formed through the sub plate in alignment with the holes formed in the deck and threadedly engaged in respective lower ends of the pipe lengths disposed in the holes formed in the deck.

19. A pool access apparatus as defined in claim 18 in which the upper bolts are configured to prevent removal by unauthorized individuals.

20. A pool access apparatus for moving a disabled person between a pool deck and a pool, the apparatus comprising:

a base axle supportable adjacent an edge of a basin and generally above a surface level of fluid retained in the basin;

an arm having an arm inner end supported on the base axle for pivotal motion about a base axis disposed coaxially with the base axle;

a seat axle carried by the arm adjacent an outer end of the arm and oriented generally parallel to the base axis;

a seat supported on the seat axle for pivotal motion about a seat axis disposed coaxially with the seat axle, the seat being configured to carry a passenger;

a driver connected between the arm and a fixed structure adjacent the basin and actuable to pivot the arm between a deployed position suspending the seat in or over the basin, and a stowed position suspending the seat in a position displaced from the basin;

a base supportable on a fixed structure adjacent an edge of a basin and generally above a surface level of fluid retained in such a basin, the base axle being fixed to the base, and the driver being connected between the arm and the base, the base being configured to removably connect to a wheeled portability kit.

21. A pool access apparatus as defined in claim 20 in which the wheeled portability kit comprises:

an elongated member configured to be connected along one edge of the apparatus base; and two wheels coaxially supported for rotation about a common transport wheel axis at respective opposite ends of the elongated member in respective positions allowing the apparatus base to lie flat on an underlying surface when the apparatus is not tilted around the wheel axis, and allowing the wheels to carry the weight of the apparatus on the underlying surface when the apparatus is tilted back around the transport wheel axis for transport across the underlying surface.

* * * * *